US010204609B2

(12) United States Patent
Canivell Grifols

(10) Patent No.: US 10,204,609 B2
(45) Date of Patent: Feb. 12, 2019

(54) CONNECTOR FOR ATTACHING A PEDAL FOR AN ELECTROPHONIC INSTRUMENT TO A PEDAL BOARD

(71) Applicant: LLEVINAC, S.L., Barcelona (ES)

(72) Inventor: Jordi Canivell Grifols, Barcelona (ES)

(73) Assignee: LLEVINAC, S.L., Barcelona (ES)

( * ) Notice: Subject to any disclaimer, the term of this patent is extended or adjusted under 35 U.S.C. 154(b) by 0 days.

(21) Appl. No.: 15/778,998

(22) PCT Filed: Jan. 5, 2017

(86) PCT No.: PCT/ES2017/070008
§ 371 (c)(1),
(2) Date: May 24, 2018

(87) PCT Pub. No.: WO2017/125629
PCT Pub. Date: Jul. 27, 2017

(65) Prior Publication Data

US 2018/0350333 A1 Dec. 6, 2018

(30) Foreign Application Priority Data

Jan. 19, 2016 (ES) ..... 201630057

(51) Int. Cl.
*G10G 5/00* (2006.01)
*G10H 1/34* (2006.01)

(52) U.S. Cl.
CPC ..... *G10G 5/00* (2013.01); *G10H 1/348* (2013.01); *G10H 2210/155* (2013.01)

(58) Field of Classification Search
CPC ..... G10G 5/00; G10H 1/348
See application file for complete search history.

(56) References Cited

U.S. PATENT DOCUMENTS 4,445,415 A * 5/1984 Izquierdo ..... G10H 1/32 206/314
5,866,829 A * 2/1999 Pecoraro ..... G10H 1/32 84/177
6,215,055 B1 * 4/2001 Saravis ..... G10H 1/348 84/422.1
6,459,023 B1 * 10/2002 Chandler ..... G10H 1/32 84/177

(Continued)

FOREIGN PATENT DOCUMENTS

EP 68195 A1 1/1983
WO 2015193526 A1 12/2015

OTHER PUBLICATIONS

International Search Report for Application No. PCT/ES2017/070008 dated Mar. 29, 2017 in 4 pages.

(Continued)

*Primary Examiner* — Robert W Horn
(74) *Attorney, Agent, or Firm* — Knobbe, Martens, Olson & Bear, LLP

(57) ABSTRACT

Connector for attaching a control pedal, use of said connector and units for fitting an adjustable pedal which comprise said connector Connector for attaching a control pedal for an electrophonic instrument to a pedal board support, which comprises at least one plate having at least one connection hole to the control pedal and at least one connection hole to the pedal board, the connection hole to the pedal board being an elongate hole.

15 Claims, 13 Drawing Sheets

(56) References Cited

U.S. PATENT DOCUMENTS

| | | | | |
|---|---|---|---|---|
| 6,538,185 | B1 * | 3/2003 | Stratton | G10H 1/32 84/422.1 |
| 7,485,792 | B2 * | 2/2009 | Collins, Sr. | G10H 1/32 84/422.1 |
| 8,536,438 | B2 * | 9/2013 | Goto | F16M 13/005 84/746 |
| 8,614,385 | B2 * | 12/2013 | McKinney | G10H 1/348 84/453 |
| 8,642,870 | B1 * | 2/2014 | Rosa | A47G 27/0212 84/453 |
| D745,923 | S * | 12/2015 | Trifilio | D17/20 |
| 9,520,118 | B2 * | 12/2016 | Canivell Grifols | G10G 5/00 |
| 9,620,094 | B2 * | 4/2017 | Abbate | G10H 1/32 |
| 9,947,302 | B2 * | 4/2018 | Canivell Grifols | G10H 1/32 |
| 9,997,149 | B2 * | 6/2018 | Trifilio | G10D 1/085 |
| 10,008,192 | B2 * | 6/2018 | Kreifeldt | G10H 1/348 |
| 2003/0061930 | A1 * | 4/2003 | Green | G10D 13/006 84/421 |
| 2004/0250673 | A1 * | 12/2004 | Salerno | G10H 1/32 84/746 |
| 2007/0295190 | A1 | 12/2007 | Collins | |
| 2011/0271821 | A1 | 11/2011 | McKinney et al. | |
| 2014/0131543 | A1 * | 5/2014 | Goto | F16M 11/043 248/429 |
| 2015/0325224 | A1 | 11/2015 | Manosa Ripoll et al. | |
| 2016/0171959 | A1 | 6/2016 | Canivell Grifols | |
| 2017/0206879 | A1 * | 7/2017 | Fiden | G10H 1/348 |
| 2018/0151162 | A1 * | 5/2018 | McKenzie | G10H 1/348 |

OTHER PUBLICATIONS

Anonymous: "A Better Alternative to Velcro", Oct. 1, 2009, XP055356234, Retrieved from the Internet: URL:http://www.lespaulforum.com/forum/show thread.php?162077-A-Better-Alternative-To-Velcro [retrieved on Mar. 20, 2017] the whole document.

Anonymous: "Cheap pedal fastener downer thingy.—Telecaster Guitar Forum", Nov. 1, 2015 (Nov. 1, 2015), XP055356279, Retrieved from the internet: URL:http://www.tdpri.com/threads/cheap-pedal-fastener-downer-thingy.597155/ [retrieved on Mar. 20, 2017] the whole document.

Anonymous: "DIY Pedalboard build—The Gear p.", Feb. 1, 2013 (Feb. 1, 2013), XP055356267, Retrieved from the Internet: URL:http://www.thegearpage.net/board/index.php?threads/diy-pedalboard-build.1210963/ [Retrieved on Mar. 20, 2017] p. 14-p. 16.

Anonymous: "Pedalock", Dec. 15, 2015 (Dec. 15, 2015), XP055356294, Retrieved from the Internet: URL:http://web.archive.org/web/20151215045513/http://www.pedalock.com/pages/models.html [retrieved on Mar. 20, 2017] figures 1-3.

Stompsters—SecureYourPedals: "Pedal Board Velcro Alternative—Stompsters", Dec. 5, 2011 (Dec. 5, 2011, pp. 1-5, XP054977225, Retrieved from the Internet: URL:https://www.youtube.com/watch?v=oGyWPxR56So [retrieved on Mar. 21, 2017] minute 0:23, 0:26, 0:27.

Stompsters—SecureYourPedals: "MXR Dyna Comp—Stompsters Pedalboard Fasteners Installation" , Dec. 6, 2012 (Dec. 6, 2012), pp. 1-3, XP054977226, Retrieved from the Internet: URL:https://www.youtube.com/watch?v=XQ_glP1KGnc [retrieved on Mar. 21, 2017] minute 1:21 and minute 2:28.

Anonymous: "Universal solution for various", May 1, 2015 (May 1, 2015), XP055357151, Retrieved from the Internet: URL:http://www.pedalboots.com/wp-content/uploads/2015/05/Produktblatt-Pedal_en.pdf [retrieved on Mar. 21, 2017] the whole document.

* cited by examiner

CONNECTOR FOR ATTACHING A PEDAL FOR AN ELECTROPHONIC INSTRUMENT TO A PEDAL BOARD

CROSS-REFERENCE TO RELATED APPLICATIONS

This application is the U.S. National Phase under 35. U.S.C. § 371 of International Application PCT/ES2017/070008, filed Jan. 5, 2017, which claims priority to Spanish Patent Application No. P201630057, filed Jan. 19, 2016. The disclosures of the above-described applications are hereby incorporated by reference in their entirety.

FIELD OF THE INVENTION

The present invention relates to a connector for attaching control pedals to pedal board supports, to the use of said connector for fitting control pedals to pedal board supports, to a unit or kit for fitting a pedal which comprises said connector and to an adjustable pedal attachment unit which also comprises said connector. The connectors according to the present invention are also generally known as adaptors.

BACKGROUND OF THE INVENTION

Control pedals are used to control or adjust the so-called electrical musical instruments or electrophonic instruments. The pedals can be actuated by hand or by foot, hence the name.

The pedals are usually positioned on pedal board supports, also known as pedal boards.

Patent documents PCT WO2014/114833A1 and WO2015/193526A1 disclose pedal board supports which comprise a board provided on the upper face thereof with multiple parallel grooves. Connectors for the pedals or control devices are coupled along the grooves. The pedals or control devices are in turn fixed or attached by two connectors.

Document WO2014/114833A1 discloses a connector which comprises a metal sheet folded at 90° which has a single elongate hole for attaching the support to each of the grooves. The portion of the metal sheet that is folded perpendicularly to the support makes contact with a side wall of the pedal that is to be connected. At least two connectors are required to connect the pedal and there is a risk that the pedal may slide.

Document WO2015/193526A1 discloses a connector that is made up of a metal sheet folded at 90° which comprises two circular holes, one for attaching the support to the pedal board and the other for receiving a suction pad for attaching to a side wall of the pedal. Said connector overcomes the aforesaid problem of the pedal sliding, but makes the positioning of the pedal rather more difficult, in particular, if there is a need to reposition said pedal in order to slightly correct the position thereof.

SUMMARY OF THE INVENTION

An object of the present invention is to disclose a support which overcomes the aforementioned problems of the prior art, disclosing means for attaching pedals to pedal boards of the above-mentioned type which are reliable, easy to install and versatile, in the sense that they are effective for different types of components.

More particularly, the present invention discloses a connector for connecting a control pedal for electrophonic instruments to a pedal board support, which comprises a plate, preferably planar, having at least one connection hole to the control pedal and at least one connection hole to the pedal board, characterised in that the connection hole to the pedal board is an elongate hole.

The present invention is based on a combination of factors which have synergic effects. The connection hole to the control pedal allows said pedal to be screwed to the pedal, thus preventing sliding. The elongate hole cooperates with the connection hole to the pedal allowing simultaneous screwing to the pedal and to the pedal board and thus helps prevent sliding. Furthermore, the holes for the pedal and the grooves of the pedal board would need to be compatible and positioned in alignment. Moreover, the combination of an elongate hole and screwing allows the position of the pedal in the pedal board to be readjusted without having to repeat the entire attachment process.

Preferably, the plate comprises a region for receiving the base of the pedal.

Thus, the pedal can be settled on the support, making assembly in two phases easier (connection of the connector to the pedal and subsequent connection of the pedal and connector unit to the pedal board).

Preferably, the plate comprises a display window for viewing the chart of pedal characteristics and instructions.

This characteristic allows, for example, the pedal to be sold together with the connector, already preinstalled.

It may also be advantageous for the connection hole (or holes) to the pedal to be elongate holes.

Preferably, the connector comprises two regions that project from the region for receiving the pedal, each located at opposite ends of the connector, each projecting region comprising an elongate hole of said type for connection to the pedal board support.

Also preferably, the region for receiving the pedal has a generally rectangular or square region comprising a connection hole to the pedal at each corner of the four-cornered region.

The present invention also provides for the connector to be made up of different parts. This may give the connector according to the present invention great versatility, as it can be applied to a wide range of pedals.

In a preferred embodiment, the connector comprises two of said plates, each plate having at least one connection hole to the control pedal and at least one elongate connection hole to the pedal board.

The present invention also comprises the use of the connector according to the present invention for attaching a control pedal for an electrophonic instrument to a pedal board support, preferably a pedal board support which comprises a board provided on the upper face thereof with multiple parallel grooves, the connector being attached to at least one of said grooves.

Given its versatility, the connector according to the present invention may form part of different commercial units or kits. In particular, the support may form part of units which include a pedal board support, or which can be sold together with pedals, either as a fitted part or as an accessory that can be fitted.

More particularly, the present invention also discloses a unit for fitting a pedal which comprises:

a pedal board support, and at least one connector according to the present invention.

Preferably, the pedal board support comprises a board provided on the upper face thereof with multiple parallel grooves for receiving pedal attachment elements.

The present invention also discloses an adjustable pedal attachment unit, characterised in that it comprises:

- a pedal which comprises an outer casing having a lower base, at least one hole for receiving a screw for closing the casing being arranged on said base.
- a connector according to the present invention, the connection hole of the connector to the control pedal corresponding to the hole for receiving said screw, such that when said hole for receiving said screw and the connection hole to the control pedal coincide, the elongate connection hole to the pedal board projects from the body of the pedal.

Preferably, a screw passes simultaneously through the hole for receiving the screw and the connection hole to the pedal, the support being attached to the pedal.

More preferably, the elongate hole is arranged parallel to the side of the pedal from which said hole projects.

BRIEF DESCRIPTION OF THE DRAWINGS

To aid understanding, explanatory yet non-limiting drawings are included of embodiments of the subject matter of the present invention.

DETAILED DESCRIPTION OF THE PREFERRED EMBODIMENTS

Figure 1:
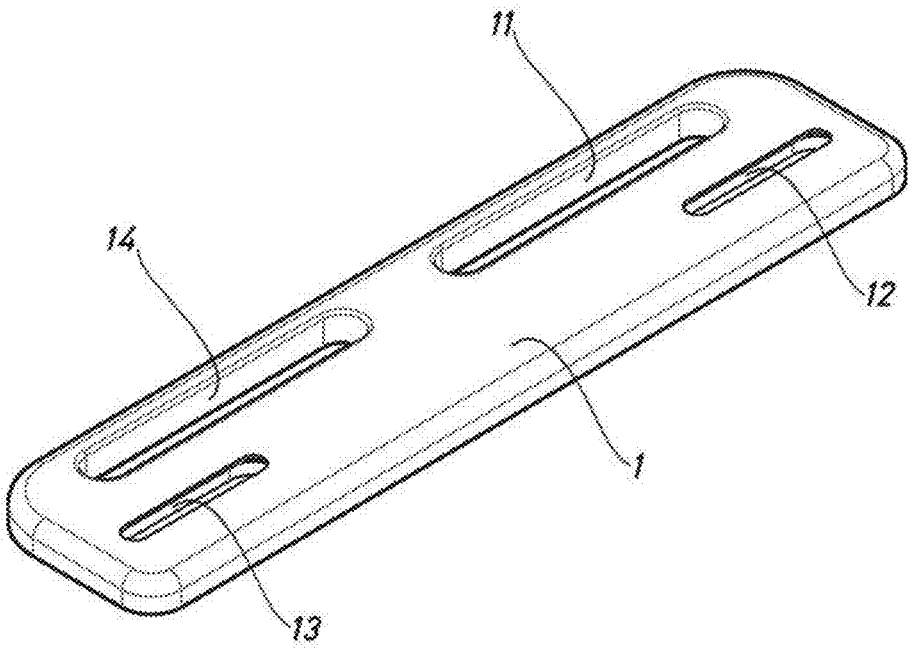
FIG. 1 is a perspective view of a first embodiment of a connector according to the present invention.
Figure 2:
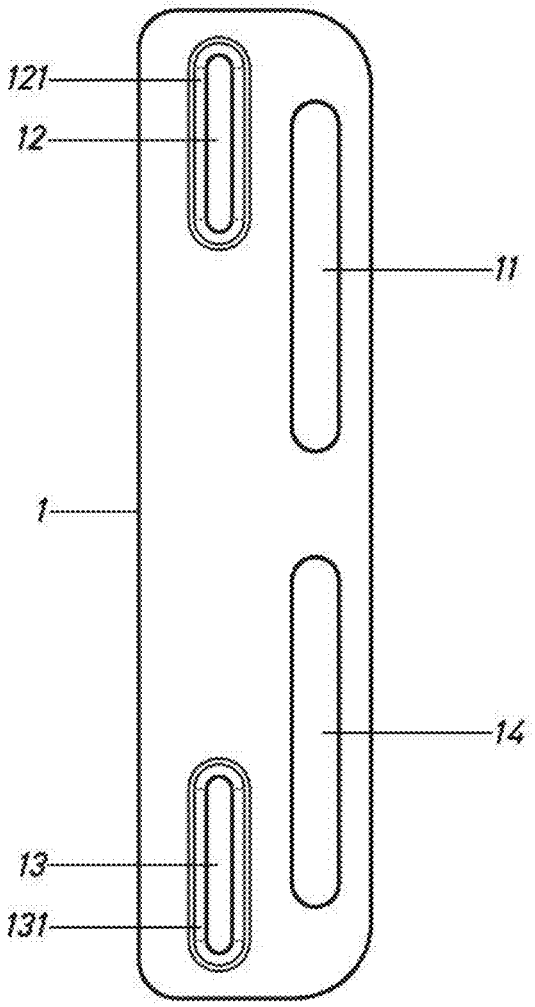
FIG. 2 is a view from above of the connector of the first embodiment.
Figure 3:
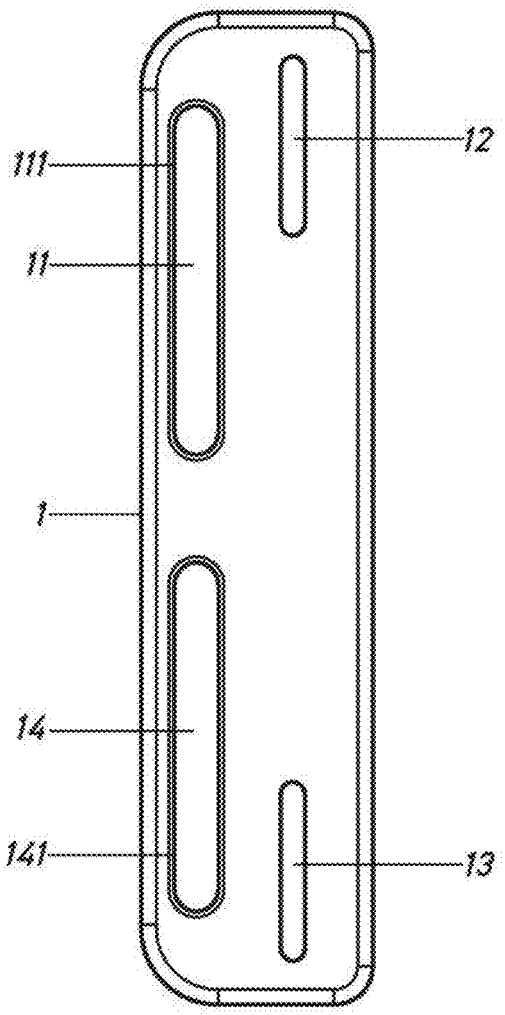
FIG. 3 is a view from below of the connector of the first embodiment.

FIG. 1 to 3 show a first embodiment of a connector according to the present invention.

The connector shown is made up of a substantially planar plate -1- which comprises two groups of differentiated holes. In this embodiment, the holes of each group are aligned with one another. A first group comprises two elongate holes -12-, -13- for receiving a screw for attachment to the pedal. A second group comprises two elongate holes -11-, -14- for receiving a device for attachment to a pedal board support (hereinafter referred to as a pedal board). The elongate holes -11- and -14- of the second group are each countersunk -111-, -141- on the upper face, whereas the elongate holes -12, -13- of the second group are each countersunk -121-, -131- on the back face. This difference in position of the countersinking corresponds to the different direction of placement of the screws for attachment to the pedal and of the device or devices for attachment of the support to the pedal board.

Figure 4:
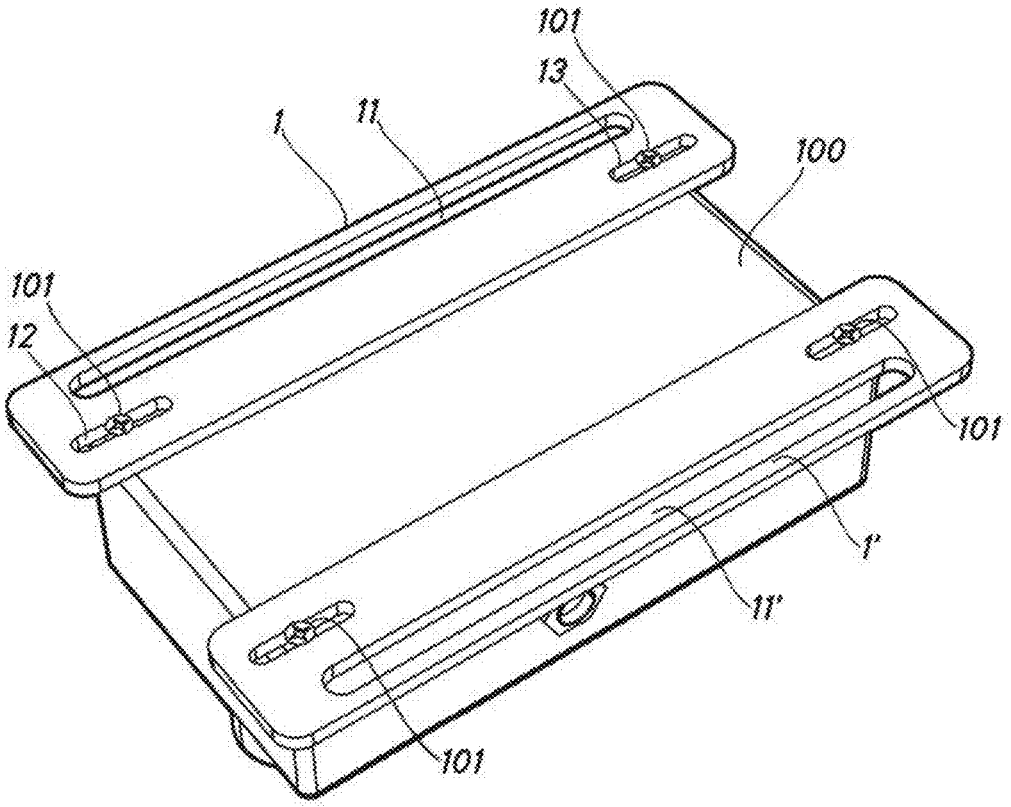
FIG. 4 is a perspective view from the lower region thereof of a pedal with a second embodiment of a connector according to the present invention.

FIG. 4 shows a second embodiment of a connector according to the present invention, already attached to a pedal -100-. In this case, the connector comprises two plates -1-, -1'- which are identical to one another. In this case, each plate -1-, -1'- has a single elongate hole -11-, -11'- for the receiving the device for attachment to the pedal board. Said elongate holes -11-, -11'- extend over the entire length of the side of the pedal -100-, such that it is possible to place more than one attachment device through the same hole -11-, -11'-.

As can be seen in the figures, each plate -1-, -1'- is attached to the pedal -100- by means of screws -101-. Accordingly, the holes -12-, -13- are arranged so as to coincide with the hole for the screws for closing the casing of the pedal -100-. It can be seen that, in this arrangement, each plate -1-, -1'- projects laterally from the pedal -100-. The elongate holes -11-, -11'- for attachment to the pedal board are located in the projecting portion and are arranged parallel to the side walls from which the plates -1-, -1'- project.

Figure 5:
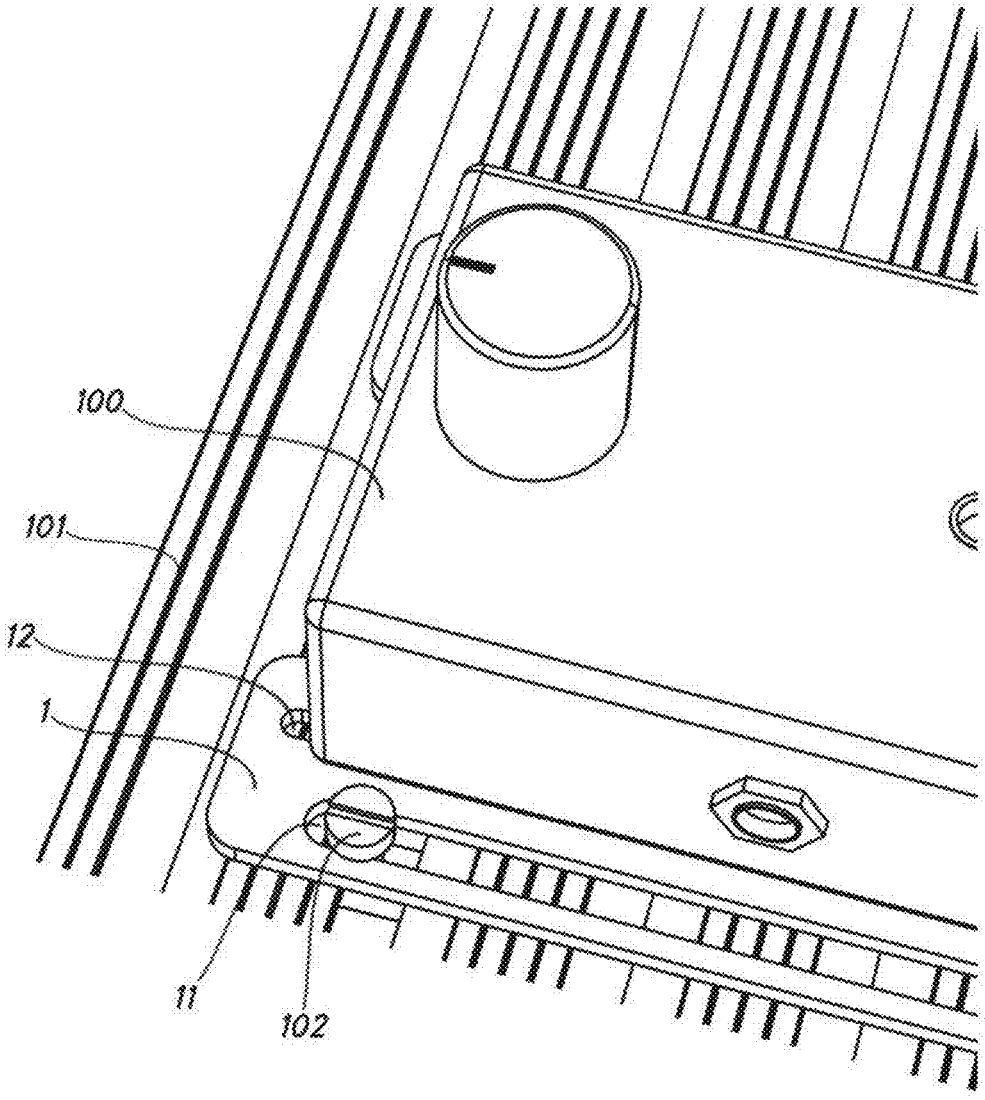
FIG. 5 illustrates the process of attaching the pedal and connector unit of the second embodiment to a pedal board support having parallel grooves.

FIG. 5 shows the attachment of the unit from FIG. 4 to a pedal board -101- which has, on the upper face thereof, multiple parallel grooves. The unit is attached by means of an attachment device -102- through the elongate hole -11- for attachment to the pedal board -101-.

The attachment device -102- may be made up of a bolt and a female device which receives the bolt (not shown), for example, a nut, which can slide inside one of the grooves of the pedal board -101-.

The female device may take other forms, such as a part having a threaded hole, the geometry of which restricts the rotation thereof inside the groove.

Figure 6:
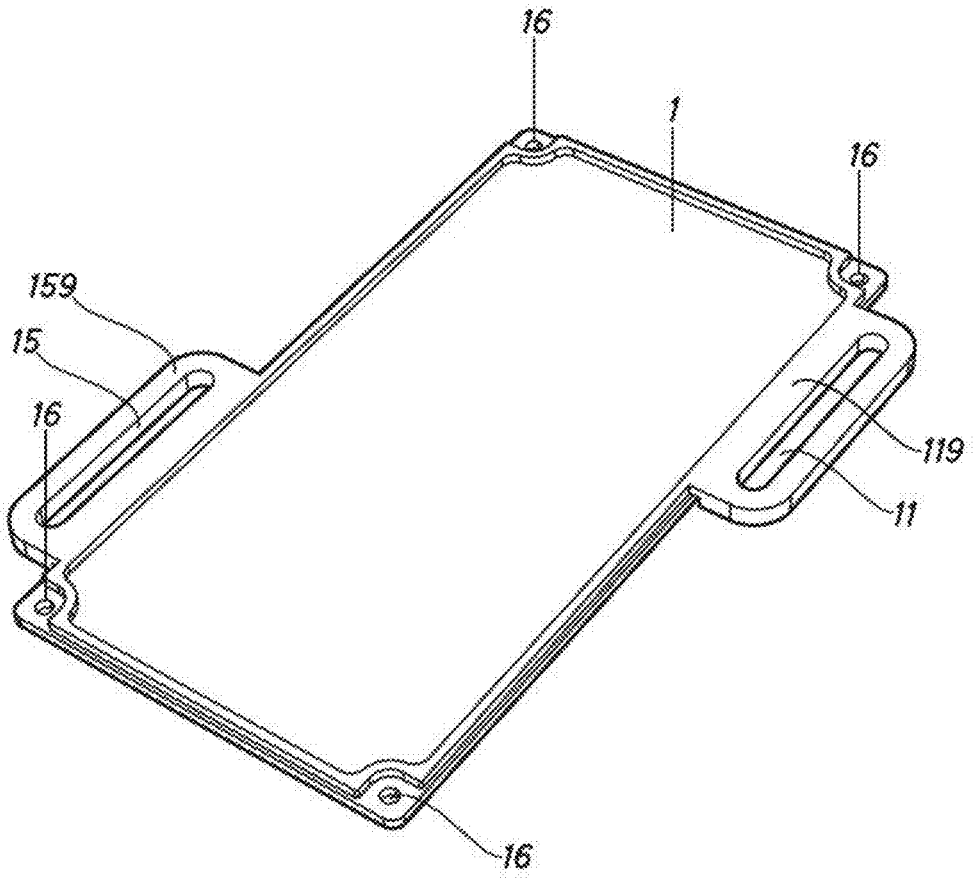
FIG. 6 is a perspective view of a third embodiment of a connector according to the present invention.
Figure 7:
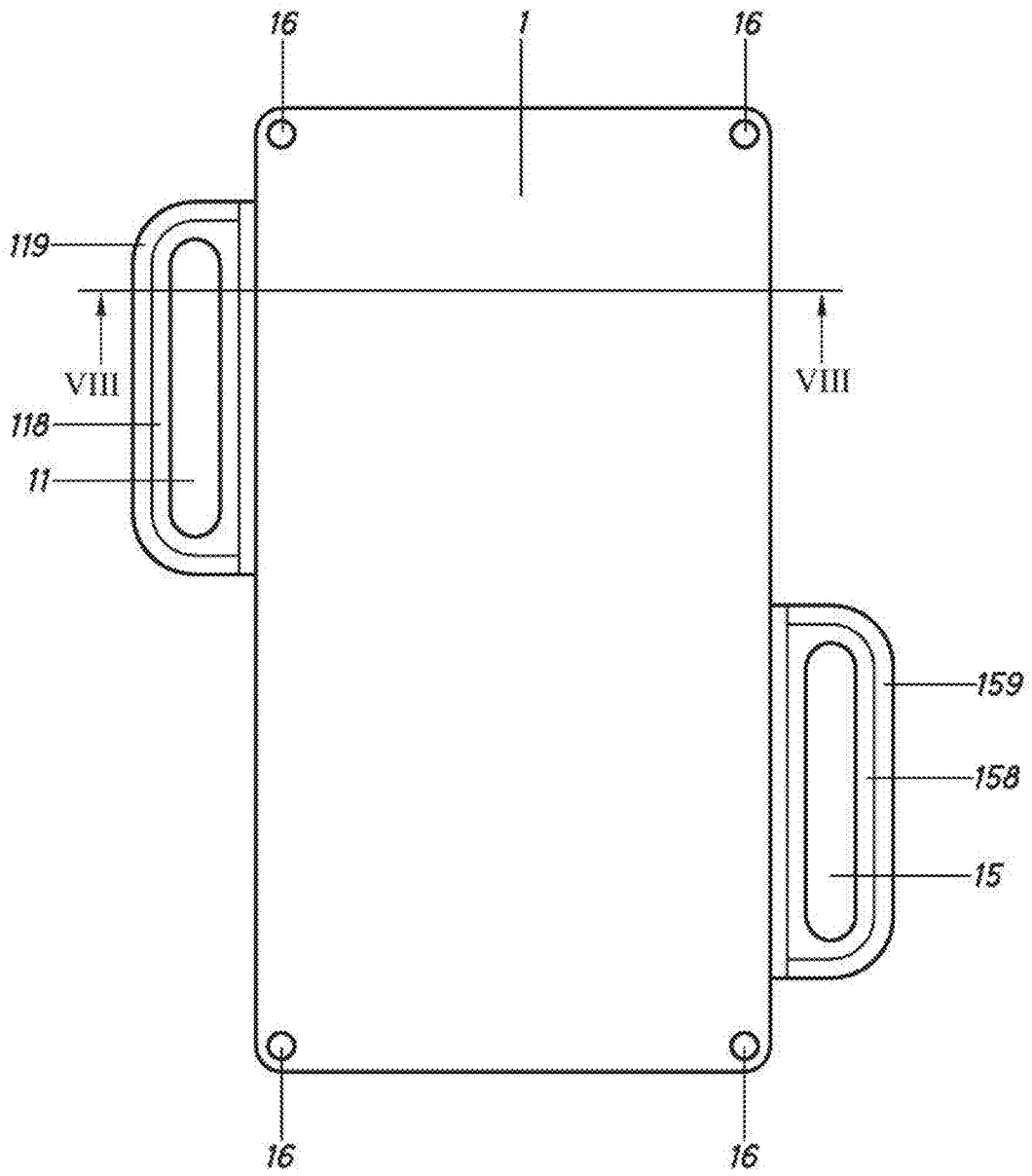
FIG. 7 is a view from above of the third embodiment from FIG. 6.
Figure 8:
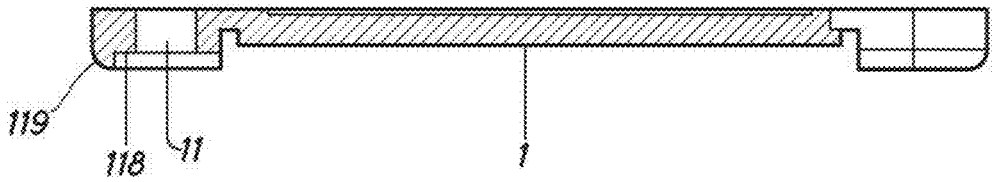
FIG. 8 is a cross section along the plane VIII-VIII from FIG. 7.

FIG. 6 to 8 show a third embodiment of a connector according to the present invention. In this case, the connector is made up of a plate -1- having a main quadrangular region which has holes -16- at each corner thereof for receiving screws for attachment to a pedal that is not shown. The main region has projecting regions -119-, -159- located on opposite sides of the connector. Each projection has an elongate hole -11-, -15- for attachment to a pedal board.

Each elongate hole -11-, -15- is located in a recessed region -158-, -118- in order to make attachment easier.

Figure 9:
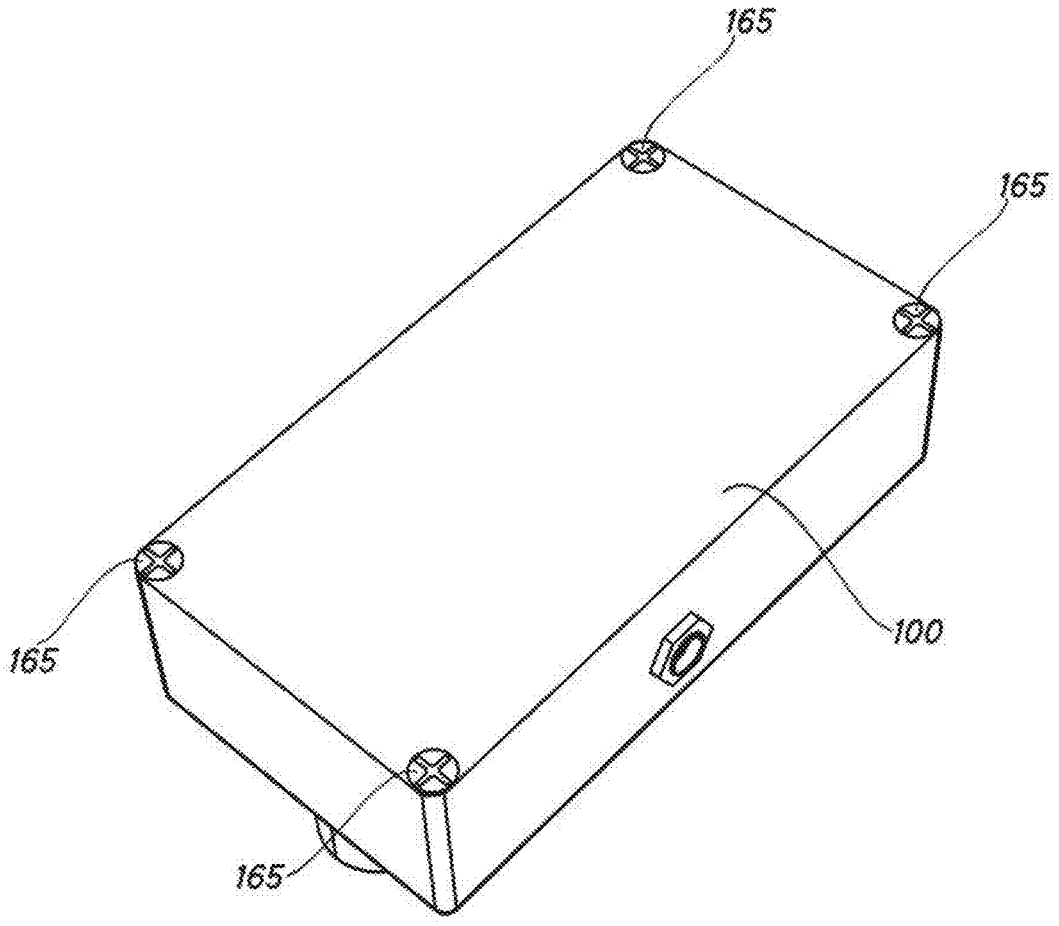
FIG. 9 is a perspective view of the lower region of a pedal.
Figure 10:
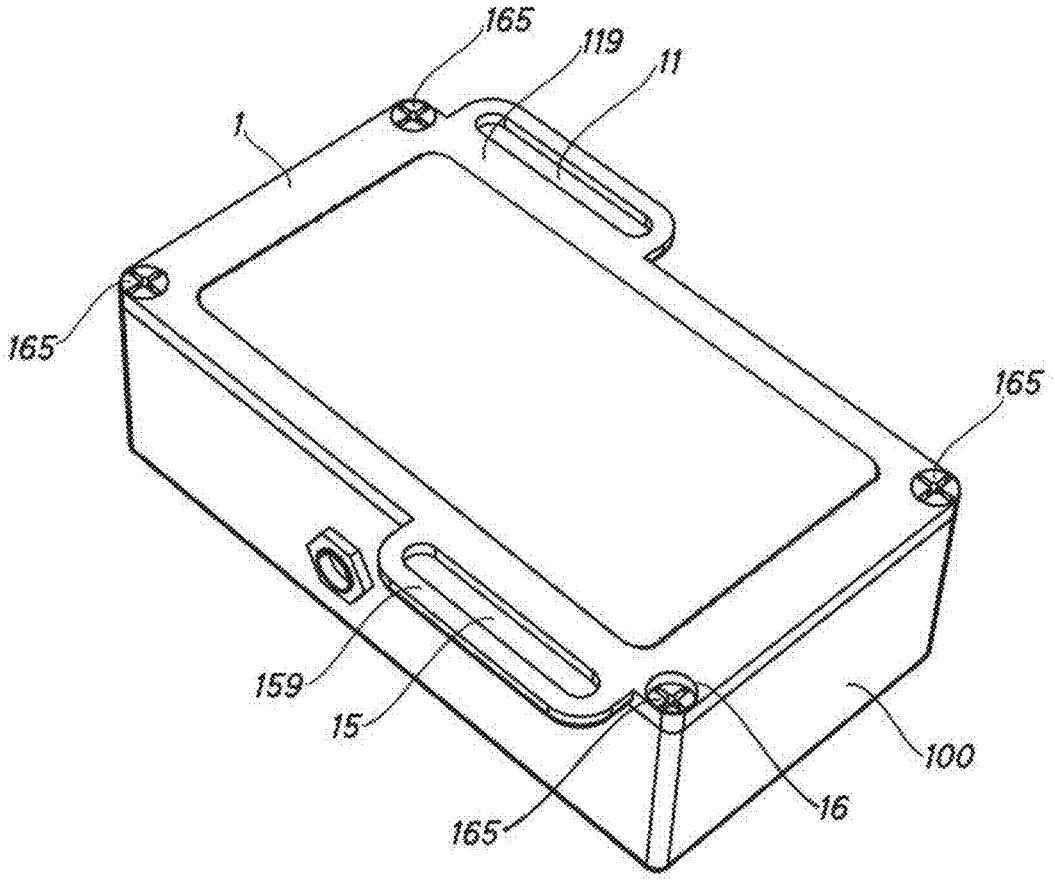
FIG. 10 shows the pedal from FIG. 9 on which said fourth embodiment has been attached.

FIGS. 9 and 10 illustrate the process of placing the connector from FIG. 8 on a pedal using the screws -165- which close the casing of the pedal.

To do this, the screws -165- that close the casing are removed, the connector is positioned so that the corresponding holes of the casing and the connector coincide and the screws -165- are screwed back in, the pedal and connector thus being connected to one another.

Figure 11:
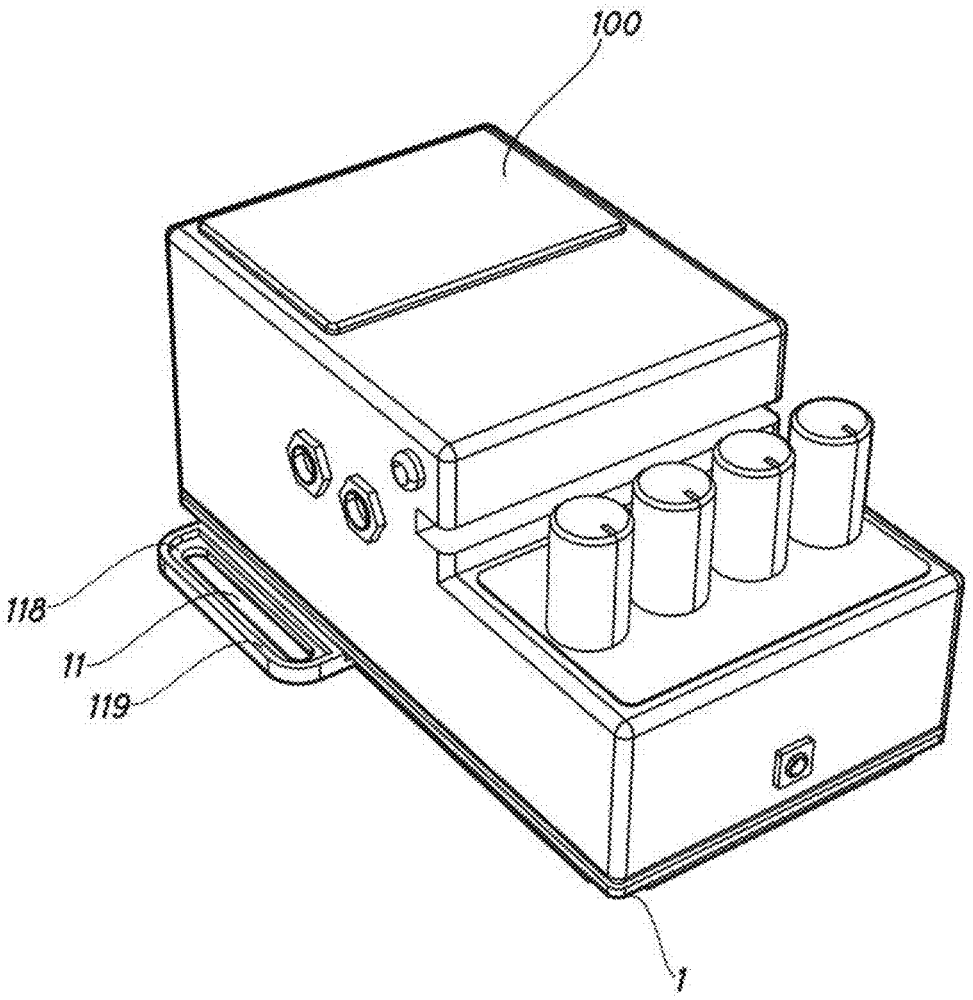
FIG. 11 is a perspective view from the upper region thereof of the pedal and connector unit from FIG. 10.

FIG. 11 shows the pedal and connector unit shown in FIG. 6 to 8 positioned so as to be fitted to the pedal from FIGS. 9 and 10.

As can be seen in the figures, the main region receives the base of the pedal -100-. In this case, said region completely covers the lower region of the pedal -100-.

Figure 12:
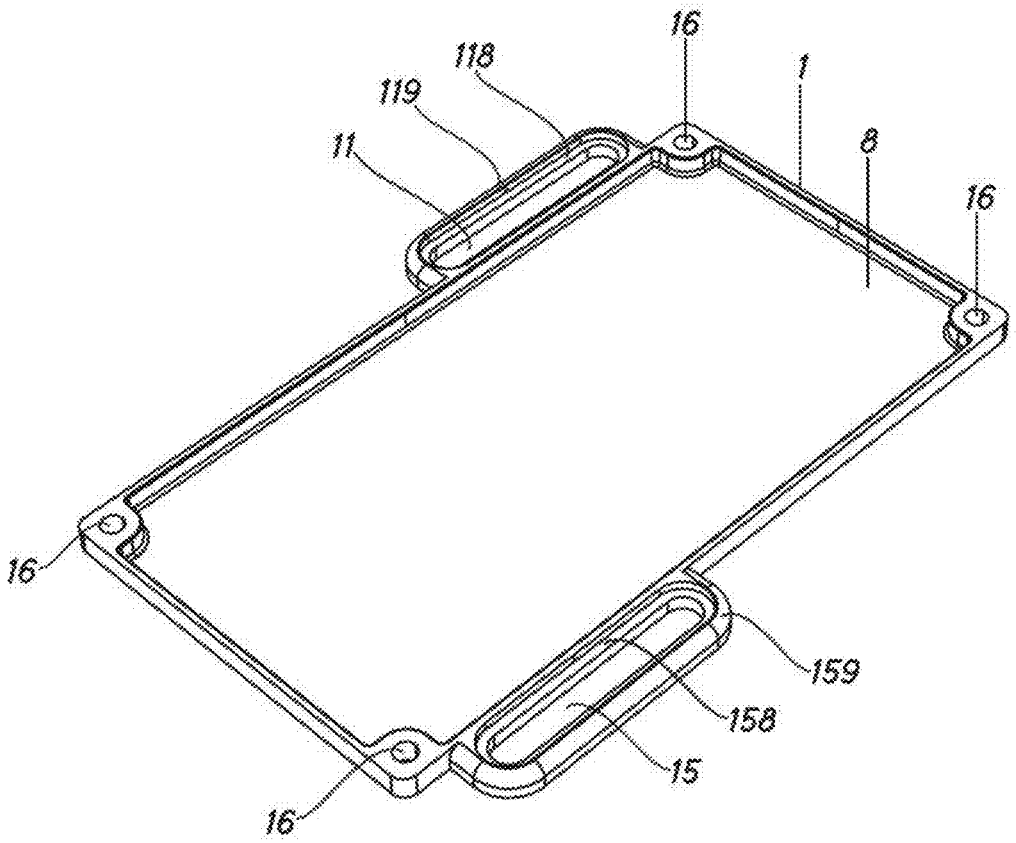
FIG. 12 is a perspective view of a fifth embodiment of a connector according to the present invention.

FIG. 12 shows a fourth embodiment of the connector according to the present invention which is similar to the third embodiment, but differs in that it has means in the main region -8- thereof that can be seen through. This is achieved by providing transparent material in said region -8-, or by making a hole.

Figure 13:
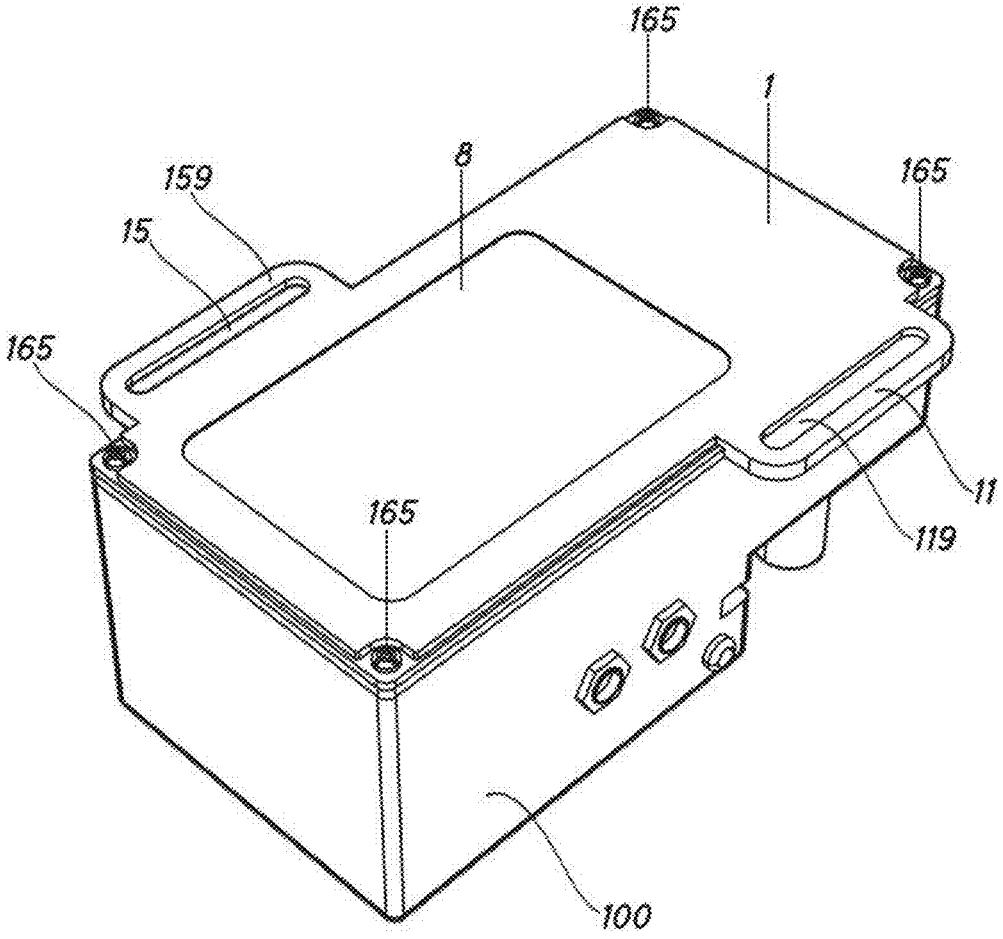
FIG. 13 is a perspective view from the lower region thereof of a pedal to which the connector of a sixth embodiment of the present invention has been attached.

FIG. 13 shows a pedal and connector unit. The connector is similar to that from FIG. 12, the difference being the size of the window or hole -8-. The region -8- in this case is a hole of which the dimensions match the sticker that shows the characteristics of the pedal -100- and that is placed beneath the window -8-. A connector can thus be installed on a pedal -100- without losing visibility of the instructions for use (such as, for example, warnings or the current adaptors required in each circumstance). This makes it easier, for example, to sell units of pedal -100- and adaptor or adaptors, with the adaptor already fitted.

It is therefore possible to sell adaptors according to the present invention separately, either alone or together with the corresponding devices for attachment to a pedal board. It is also possible to sell pedal boards together with suitable adaptors, or alternatively pedals together with the corresponding adaptors.

The form of the adaptors may vary according to the circumstances. The plate may be planar or of another arrangement, although it is preferable for the holes for attachment to the pedal and the holes for attachment to the pedal board to be arranged in parallel planes, and more preferably, in the same plane.

The adaptor according to the present invention may also be made of different materials, such as plastics materials, metal, etc.

Although the invention has been set out and described with reference to embodiments thereof, it should be understood that these do not limit the invention, and that it is possible to alter many structural or other details that may prove obvious to persons skilled in the art after interpreting the subject matter disclosed in the present description, claims and drawings. Therefore, the scope of the present invention includes any variant or equivalent that could be considered covered by the broadest scope of the following claims.

What is claimed is:

1. A connector for attaching a control pedal for an electrophonic instrument to a pedal board support comprising at least one plate having at least one connection hole to the control pedal and at least one connection hole to the pedal board, wherein the connection hole to the pedal board is an elongate hole.

2. The connector according to claim 1, wherein said plate is planar.

3. The connector according to claim 1, said connector comprises two plates, each plate comprises at least one connection hole to the control pedal and at least one elongate connection hole to the pedal board.

4. The connector according to claim 1, wherein the connection hole to the control pedal is an elongate hole.

5. The connector according to claim 1, wherein the plate comprises a region for receiving a base of the pedal.

6. The connector according to claim 5, wherein the region for receiving the pedal is rectangular or square and has a connection hole to the pedal at each corner of the four-cornered region.

7. The connector according to claim 5, wherein the plate comprises a window for viewing the chart of pedal characteristics and instructions.

8. The connector according to claim 1, further comprising two projecting regions, each being located at opposite ends of the connector, each comprising an elongate hole of said type for connection to the pedal board.

9. The connector according to claim 8, wherein the region for receiving the pedal is rectangular or square and has a connection hole to the pedal at each corner of the four-cornered region.

10. The connector according to claim 1, wherein the pedal board support comprises a board provided on the upper face thereof with multiple parallel grooves, and the connector are configured to be attached to at least one of said grooves.

11. An unit for fitting a control pedal for an electrophonic instrument to a pedal board support, which comprises:

a pedal board support, and at least one connector according to claim 1.

12. The unit according to claim 11, wherein the pedal board support comprises a board provided on the upper face thereof with multiple parallel grooves for receiving a pedal attachment element.

13. A control pedal unit for an electrophonic instrument comprising:

a pedal which comprises an outer casing having a lower base, at least one hole for receiving a screw for closing the casing being arranged on said base; and a connector according to claim 1, wherein the connection hole of the connector to the control pedal corresponds to the hole for receiving said screw, such that when said hole for receiving said screw and the connection hole to the control pedal coincide, the elongate connection hole to the pedal board projects from the body of the pedal.

14. The control pedal unit according to claim 13, wherein the screw passes simultaneously through the hole for receiving the screw and the connection hole to the pedal, the support being attached to the pedal.

15. The control pedal unit according to claim 13, wherein the elongate hole is arranged parallel to the side of the pedal from which it projects.

* * * * *